US005516209A

United States Patent [19]

Flint et al.

[11] Patent Number: 5,516,209

[45] Date of Patent: May 14, 1996

[54] DISPOSABLE STATIC MIXING DEVICE WITH A REUSABLE HOUSING

[76] Inventors: Theodore R. Flint, P.O. Box 50, Elverson, Pa. 19520; Thomas D. Steinmetz, 2648 Union Ave., Pennsauken, N.J. 08109

[21] Appl. No.: 340,197

[22] Filed: Nov. 15, 1994

[51] Int. Cl.[6] ..... B01F 5/06

[52] U.S. Cl. ..... 366/340; 366/336; 138/42; 138/44

[58] Field of Search ..... 366/130, 189, 366/336, 337, 340, 349; 138/42, 44; 206/219, 221

[56] References Cited

U.S. PATENT DOCUMENTS

| | | | |
|---|---|---|---|
| Re. 28,072 | 7/1974 | Sluijters . | |
| 1,711,270 | 4/1929 | Litle, Jr. | 138/42 |
| 2,322,026 | 6/1943 | Jaeckel | 48/180 |
| 2,517,027 | 8/1950 | Rado | 222/94 |
| 2,965,695 | 12/1960 | Sleicher, Jr. | 260/683.75 |
| 3,159,312 | 12/1964 | Van Sciver, II | 222/137 |
| 3,335,912 | 8/1967 | Reeves, Jr. | 222/94 |
| 3,394,924 | 7/1968 | Harder . | |
| 3,460,809 | 8/1969 | Hauss . | |
| 3,738,615 | 6/1973 | Brasie . | |
| 3,866,800 | 2/1975 | Schmitt | 222/94 |
| 3,893,654 | 7/1975 | Miura et al. . | |
| 3,980,222 | 9/1976 | Hood | 229/22 |
| 4,002,289 | 1/1977 | Moore | 229/44 |
| 4,027,857 | 6/1977 | Cunningham | 366/340 |
| 4,037,758 | 7/1977 | Bourque | 222/134 |
| 4,093,188 | 6/1978 | Horner | 366/336 |
| 4,099,651 | 7/1978 | Von Winckelmann | 222/94 |
| 4,112,520 | 9/1978 | Gilmore | 366/337 |
| 4,198,168 | 4/1980 | Penn | 366/336 |
| 4,271,984 | 6/1981 | Ducros et al. | 222/94 |
| 4,310,493 | 1/1982 | Pisaric et al. | 422/135 |
| 4,316,673 | 2/1982 | Speer | 366/337 |
| 4,325,513 | 4/1982 | Smith et al. | 239/112 |
| 4,331,264 | 5/1982 | Staar | 222/94 |
| 4,352,572 | 10/1982 | Chen et al. | 366/145 |
| 4,408,893 | 10/1983 | Rice, III | 366/339 |
| 4,431,311 | 2/1984 | Kolossow | 366/79 |
| 4,511,258 | 4/1985 | Federighi et al. | 366/337 |
| 4,522,504 | 6/1985 | Greverath | 366/339 |
| 4,528,180 | 7/1985 | Schaeffer | 424/52 |
| 4,538,920 | 9/1985 | Drake | 366/177 |
| 4,548,606 | 10/1985 | Larkin | 604/414 |
| 4,632,568 | 12/1986 | Emele et al. | 366/337 |
| 4,643,336 | 2/1987 | Mandeville et al. | 222/145 |
| 4,907,725 | 3/1990 | Durham | 222/129 |
| 4,952,068 | 8/1990 | Flint | 366/337 |
| 5,154,321 | 10/1992 | Shomer | 222/145 |
| 5,255,974 | 10/1993 | Signer | 366/336 |

FOREIGN PATENT DOCUMENTS

| | | | |
|---|---|---|---|
| 676901 | 12/1963 | Canada . | |
| 60-12890 | 4/1985 | Japan | 366/130 |

*Primary Examiner*—Charles E. Cooley

[57] ABSTRACT

A static mixing device includes a disposable mixing conduit, a rigid, reusable housing for supporting the mixing conduit, and a reusable coupling for attaching an inlet of the mixing conduit to an outlet of a source of flowable components to be mixed. The mixing conduit provides a circuitous flowpath for the components between the inlet and outlet. At least two facing sheets of material (or the opposite walls of a tube), at least one of the sheets being flexible, are sealed together at interior obstructions, forming mixing stages that subdivide and recombine the stream of material. The rigid housing can be bayonet shaped or cylindrical, and forms an applicator with the flexible mixing device. The coupling can capture the inlet end of the mixing conduit.

14 Claims, 7 Drawing Sheets

DISPOSABLE STATIC MIXING DEVICE WITH A REUSABLE HOUSING

BACKGROUND OF THE INVENTION

1. Field of the Invention

This invention relates generally to mixing devices, and more particularly to a static mixing device for mixing plural flowable components of a composition by combining, subdividing and recombining streams of the components moving along a flowpath from a source to a discharge. The mixing device includes a disposable static mixing conduit formed of flexible material providing a baffled, circuitous flowpath, a reusable rigid support structure for the conduit and a reusable link structure for providing a secure coupling between the conduit and the source of the flowable components.

2. Description of the Prior Art

Static mixing devices are known in the art with fixed structures partially obstructing the flow of materials in a stream flowing through the device. In order to pass the obstructions the materials must follow a circuitous path, which causes eddies and the like and mixes the materials more thoroughly than is possible where material streams from plural sources are carried along an unobstructed passage. This is particularly true for relatively viscous materials, the mixing of which may otherwise require extensive kneading of the materials, e.g., in a flexible bag.

An example of such a device is disclosed in U.S. Pat. No. 4,952,068—Flint, the disclosure of which is hereby incorporated. The conduit therein is formed from opposing sheets of material defining a flexible multi-component squeeze container. Seams join the perimeters of opposing sheets to form a flexible container, with at least one internal wall dividing the container into at least two storage compartments for storing the flowing components before they are brought together for use, and at least one internal wall further downstream for mixing. External pressure on the container forces the plural components to combine in an initial mixing area along a flowpath in the container, downstream of the walls defining the storage compartments. The downstream dividing wall (or walls) is positioned between the initial mixing area and a container outlet. The stream of flowing materials separates and recombines one or more times prior to exit from the container, which provides improved mixing as compared to a substantially laminar flow through an unobstructed conduit.

Normally, a mixing structure as described is used once and discarded. If the mixed components are, for example, a curable resin and a curing agent, material remaining in the mixing structure will harden and obstruct the flowpath. Therefore, the mixing structure is generally not made particularly durable, nor is it associated with an applicator structure that might facilitate application, such as an applicator blade.

A major advantage of a flexible mixing structure is that it can be substantially emptied of material, for example by compressing the mixing structure proceeding from the source toward the discharge end. A rigid structure which cannot be compressed in this manner retains material along the mixing flowpath. Assuming, for example, that the mixed components include a curable resin and a curing agent, any material which remains in the mixing conduit hardens there and is wasted, as well as rendering the device unfit for further use. On the other hand, there are certain advantages to more rigid structures such as their durability and ease of attachment to a source container (e.g., with a threaded neck), their capability to be used as an applicator, etc.

It would be advantageous to provide an improved mixing dispenser in the form of a flexible mixing conduit with durable means to be attached to a source of plural flowable components, such as a multi-component sealant cartridge, for mixing components as they are dispensed. It would also be advantageous to employ a support structure that can facilitate kneading as well as compression of the conduit to empty it, and can be used as an applicator blade or the like, but which is not wasted after a single use.

SUMMARY OF THE INVENTION

It is an object of the invention to provide a static mixing device capable of attachment to a source of plural flowable components.

It is another object of the invention to provide a static mixing device that includes a reusable, secure linkage to a source of plural flowable components and a disposable flexible mixing conduit that can be substantially emptied.

It is another object of the invention to provide a static mixing device that is capable of attachment to a source of plural flowable components, that includes a reusable rigid frame for providing a sturdy applicator base for the dispensing product, and that can be used with a disposable, mixing conduit of a type adapted for either or both of turbulent mixing and geometric mixing of the components.

These objects and others are satisfied according to the invention in a static mixing device capable of secure attachment to a source of plural flowable components, having three basic units: a disposable, baffled mixing conduit that is flexibly compressible, a reusable housing for supporting the conduit, and a reusable coupling mechanism for providing a secure coupling between the mixing conduit and the source of plural flowable components, the housing and coupling providing a rigid support structure for the flexible conduit. The mixing conduit has at least one layer of flexible material. The coupling mechanism is adapted for removable attachment to an outlet of the source of plural flowable components, for example with a female threading for attachment to a threaded neck of the source container. The coupling mechanism is also structured to receive and connect to the mixing conduit, for example with a clamping or resilient collar for attaching a neck of the conduit to the coupling mechanism.

According to a further aspect of the invention, the mixing conduit can be formed by sealing together multiple layers of flexible sheet material, e.g., at seams located at peripheral edges and at points between the peripheral edges to form mixing obstructions. An inlet at one end of the conduit and an outlet at an opposite end are defined by the sheet material and the respective seams. At least one baffle is formed between the inlet and the outlet by joining together the sheets at least at one discrete location, defining a circuitous flowpath along the conduit and its mixing obstructions, including the baffle.

According to another aspect of the invention, the mixing conduit can include three sheets of flexible material. A first set of compartments are formed by a plurality of spaced seams extending between side seams and joining together the top sheet and an interior sheet. A second set of compartments are similarly formed by seams joining the middle and bottom sheets, the second set of compartments overlapping the first set. Perforations or openings in the interior sheet connect between different compartments such that the flowpath passes through the respective compartments via the perforations. The mixing conduit provides an extensive three-dimensional circuitous flowpath that divides and recombines multiple layers of flowable materials introduced from the source of plural flowable components until a desired mix is achieved, at which point the fluid mixture is dispensed from an outlet at a discharge end of the conduit.

According to another aspect of the invention, the baffled flowpath of the mixing conduit can be designed to provide one of turbulent mixing and geometric mixing of the plural flowable components. In this regard, "geometric" mixing is construed to include subdividing and recombining streams at points spaced serially along the flowpath, whereby the components become distributed in a cross section of the resulting stream. The optimal type of conduit depends upon the viscosity of the flowable components. Relatively more viscous components are advantageously mixed by geometric mixing, whereas relatively less viscous components may be mixed adequately by turbulence.

The extent of the three-dimensional flowpath can be improved by constructing the baffled conduit with at least one layer of elastomeric material, such as a urethane film. When an increase of pressure accumulates within the conduit, for example due to the flow of the flowable materials, the elastomeric material stretches to allow a more voluminous flow space within the conduit. Whereas the conduit is also flexible, mixing can be supplemented by kneading.

The housing is intended to provide support for the device, making it a sturdy applicator of the dispensing product such that the mixed product can be directed into a gap or the like in the manner of a rigid nozzle even though the conduit is otherwise flexible and can be collapsed fully to discharge its contents. The housing also can have a flat, spatula-like side, e.g., for smoothing. The coupling mechanism preferably includes a rigid, generally tubular linking member and a collar. An inlet end of the baffled conduit is captured by radial pressure between the linking member and the collar. The collar can be resilient, but preferably comprises a gasket and clasp that bears inwardly toward the linking member of the coupling mechanism. The collar can have a latching toggle lever for shortening its circumference to bear inwardly on the inlet end of the flexible conduit, preferably over a gasket.

According to another aspect of the invention, the housing can include an elongated member connected at one end to the coupling member, and the mixing conduit includes a sleeve for sliding over a distal end of the elongated member.

According to another aspect of the invention, the housing can include a tube, preferably conical-shaped, connecting at a large end to the coupling means, whereby the mixing conduit is supported within the conical-shaped tube.

These and other objects of the present invention will be more fully understood from the following description of the invention with reference to the illustrations appended hereto.

DESCRIPTION OF THE PREFERRED EMBODIMENTS

Figure 1:
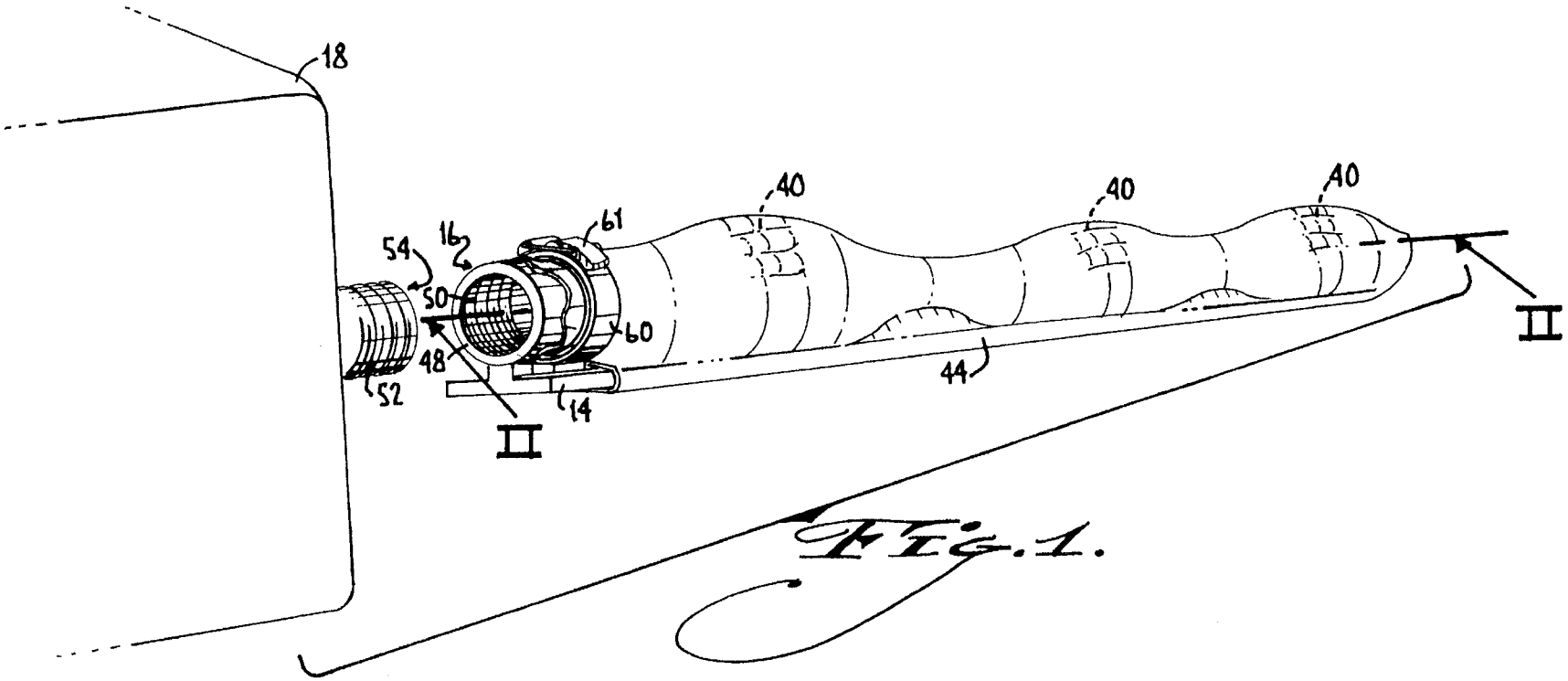
FIG. 1 is a perspective view of one embodiment of the invention.

FIGS. 1–5 show a first embodiment of a mixing device 10 according to the invention. Device 10 includes a disposable mixing conduit 12 primarily useful for turbulent mixing of relatively low viscosity flowable components of a composition, a rigid, reusable housing 14, and a reusable coupling mechanism 16 adapted for providing a secure, detachable coupling between the mixing conduit 12 and a container 18 from which the plural flowable components of the composition may be obtained.

Figure 2:
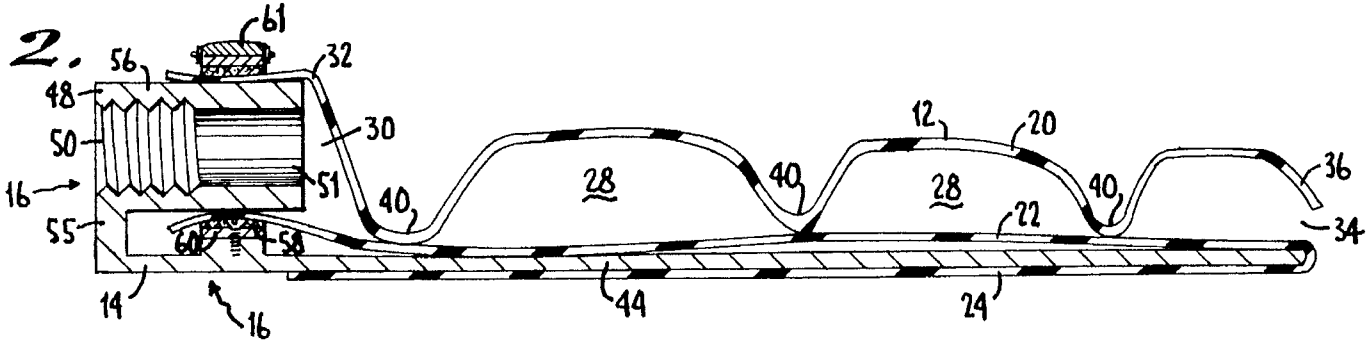
FIG. 2 is a section view along line II—II of FIG. 1.
Figure 3:
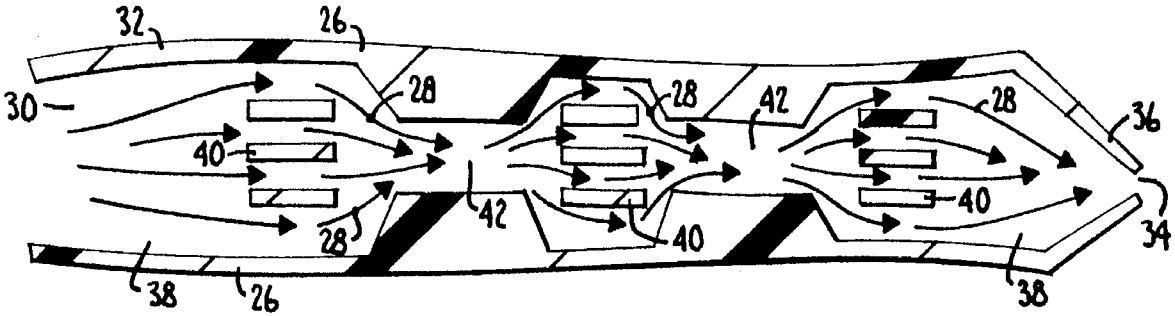
FIG. 3 is a plan section view vertically downward through FIGS. 1 or 2.
Figure 4:
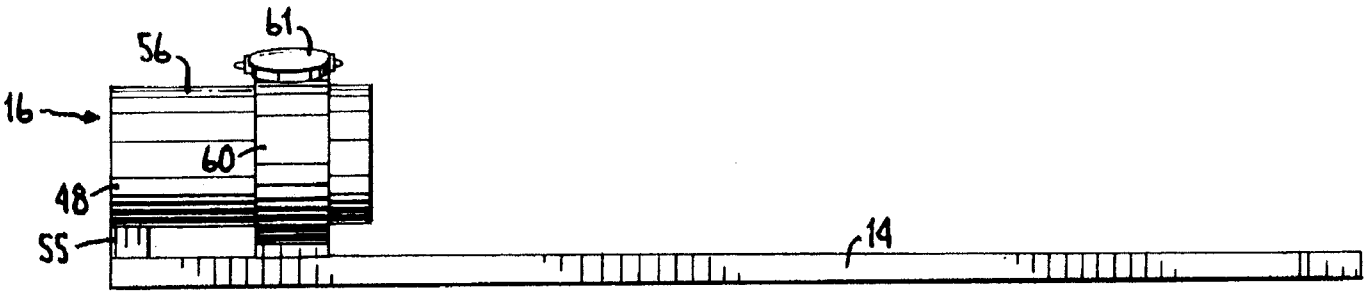
FIGS. 4 and 5 are elevation and plan views respectively of the link and housing of the embodiment shown in FIG. 1.
Figure 5:
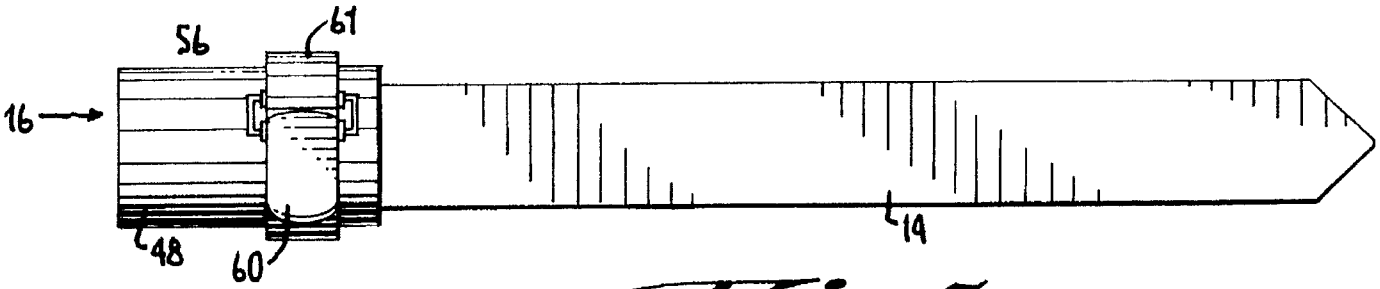

The mixing conduit 12 is fabricated from three facing sheets 20, 22, 24 of a preferably flexible, impermeable material, for example, thermoplastic elastomers such as polystyrene-dienes, polyurethanes, copolyester-ethers or other flexible elastomers. Preferred materials include Delrin® type copolyethers of formaldehyde/ethyleneoxide. The sheets 20, 22, 24 are sealed together at seams 26 located at peripheral edges as shown in FIGS. 2 and 3, for example by heat sealing, ultrasonic welding, adhesive or the like. A flowpath 28 in mixing conduit 12 is defined between seams 26 and facing sides of top and intermediate sheets 20 and 22, respectively. The seams also define a conduit inlet 30 at an inlet end 32, a conduit outlet 34 at an outlet end 36 and an internal mixing portion 38 communicating with the conduit inlet 30 and the conduit outlet 34. Between inlet 30 and outlet 34, the conduit defines a circuitous path that causes mixing due to eddies, turbulence and the separation and recombination of localized streams of material.

In the embodiment shown, the conduit is defined in part by opposite peripheral seams extending parallel to the general flowpath. It will be appreciated that the particular seam configurations are subject to variations. For example, the flexible material can be continuous along a side and folded over, as opposed to being seamed in the sense of having attached marginal edges. As another example, seams and obstructions can be provided in a tube configuration by internal points of attachment of the tube walls to one another or to one or more webs disposed within the tube. Peripheral seams are discussed by way of example, because this structure is easily formed from web layers.

The mixing portion 38 in the illustrated embodiment has three sets of barriers or obstructions 40, along the flowpath 28 between the conduit inlet 30 and the conduit outlet 34, for mixing the flowable components of the composition as they pass from the inlet to the outlet. The obstructions 40 can be positioned symmetrically along the longitudinally extending flowpath 28. The obstructions are formed by fastening opposing portions the two facing sheets 20, 22 in a similar fashion to the joining of the peripheral seams 26. In conjunction with obstructions 40, the seams 26 define constrictions or narrow passages 42 in the flowpath 28 at longitudinal positions intermediate to the obstructions 40. Thus, the plural flowable components of the composition, in flowing along the flowpath 28, are successively brought together at the narrow passages 42 and divided at the obstructions 40, thereby mixing the components before they are dispensed through conduit outlet 34.

The facing sides of sheets 22 and 24, and seams 26 define a sheath 44 as shown in FIG. 1. Sheath 44 includes a sheath opening at the inlet end 32 of the conduit 12 into which the preferably bayonet-shaped housing 14 can be inserted, thereby supporting the mixing conduit 12 and enabling easy application of the mixed composite at a desired dispensing point. Whereas the housing supports the flexible conduit and substantially rigidly positions the conduit outlet 34, the device forms a applicator useful for dispensing along interior corners and other surfaces that would be difficult to reach or to follow accurately with a relatively more flaccid applicator. In addition, housing 14 provides a relatively rigid structure against which the flexible conduit can be pressed for kneading and for forcing material along the conduit to the discharge end.

Housing 14 can comprise one or more of a variety of rigid plastic materials such as polyamides, polystyrenes, polyolefins, polyacrylonitriles, polyvinyls and the like. Alternatively, housing 14 can be fabricated from another relatively rigid material, such as metal, wood, fiber-plastic composites, or other known materials. In an alternative embodiment, the top sheet 20 is flexible, and one or both of the intermediate sheet 22 and the bottom sheet 24 that form the sheath with top sheet 20, are rigid or semi-rigid.

The coupling 16 includes a generally tubular attachment member 48, shown in FIGS. 1, 2, 2*a*, 4 and 5, for example having female screw threads 50 defined on an inner radial surface 51, for attaching to mating threads 52 on an outlet 54 of a container 18 from which material is to be dispensed. The attachment member 48 in this embodiment is rigidly connected to housing 14 by a bridge 55. The attachment member 48 and the housing 14 can be formed integrally of a single piece of molded material, such as plastic, or joined by a known method, such as by welding, adhesive or one or more fasteners.

Figure 2A:
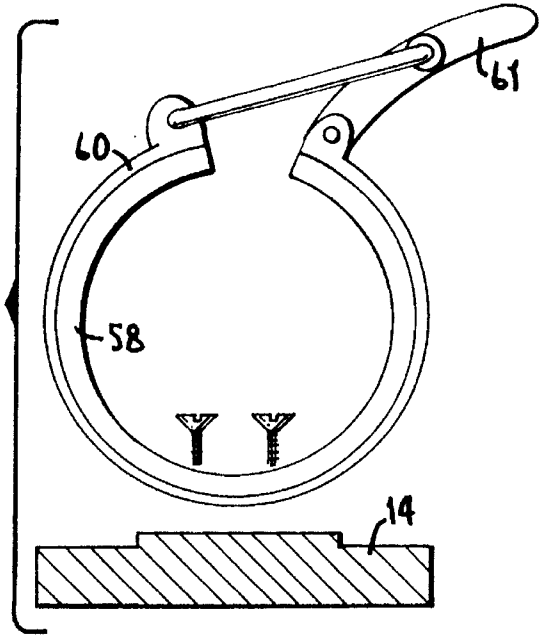
FIG. 2*a* is an exploded elevation view showing the clasp of FIGS. 1 and 2.

The attachment member 48 has a peripheral radial surface 56 over which the conduit inlet 30 is placed. The mixing conduit 12 is held securely on the link member 48 via a collar. The collar preferably comprises a resilient gasket 58, and a clamping ring 60 that has a latching lever 61 for shortening the circumference of ring 60 to lock conduit 12 on link member 48. It is also possible to hold the conduit on the link member, albeit less positively, using a resilient band. FIG. 2*a* illustrates the structure of the clamping ring 60. In the embodiment illustrated, sheet 24 does not extend as far as sheets 20 and 22 so that the sheath 44 protrudes for easy attachment over attachment member 48, without interference.

Figure 6:
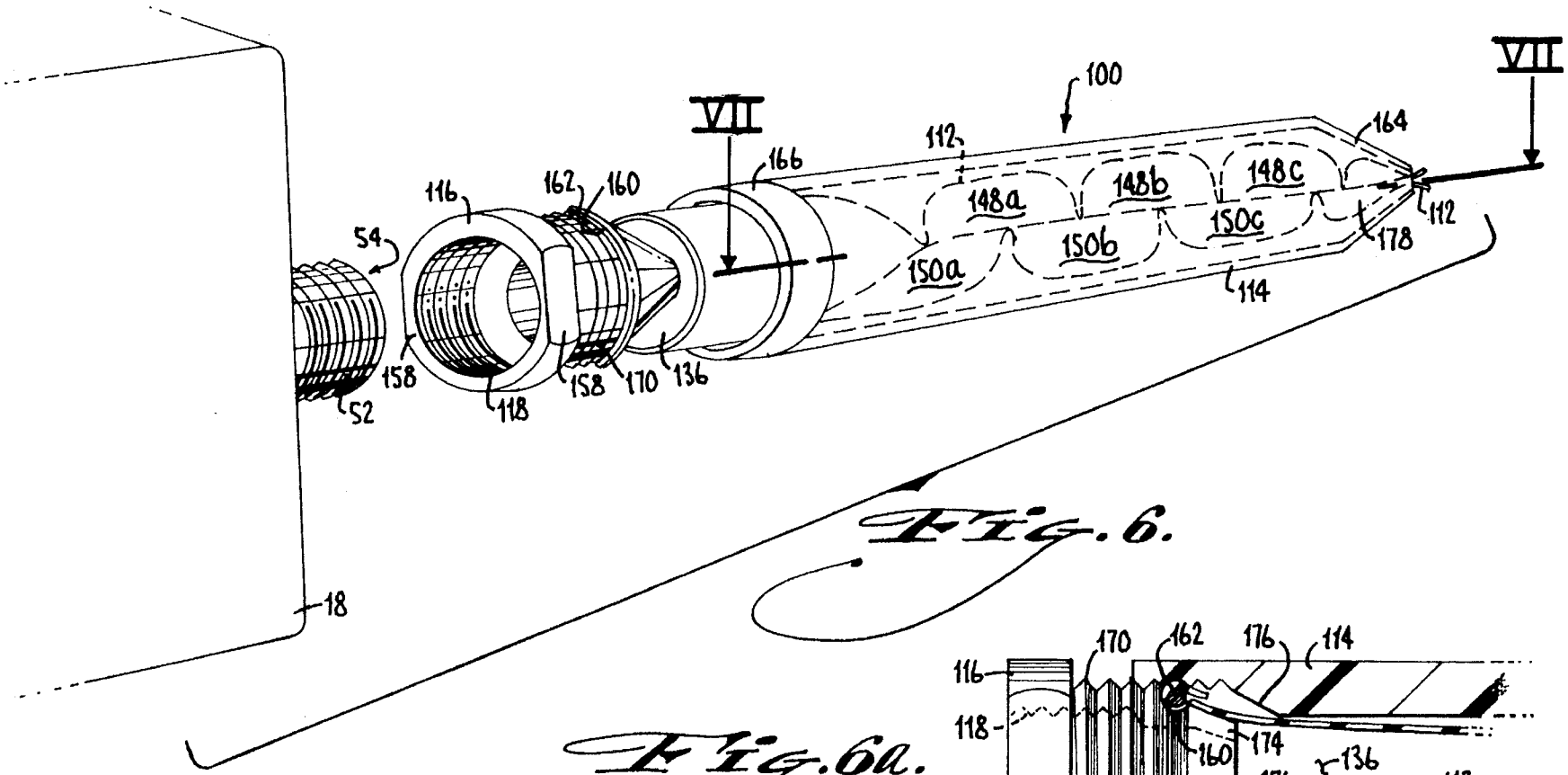
FIG. 6 is an exploded perspective view of a second embodiment of the invention.
Figure 7:
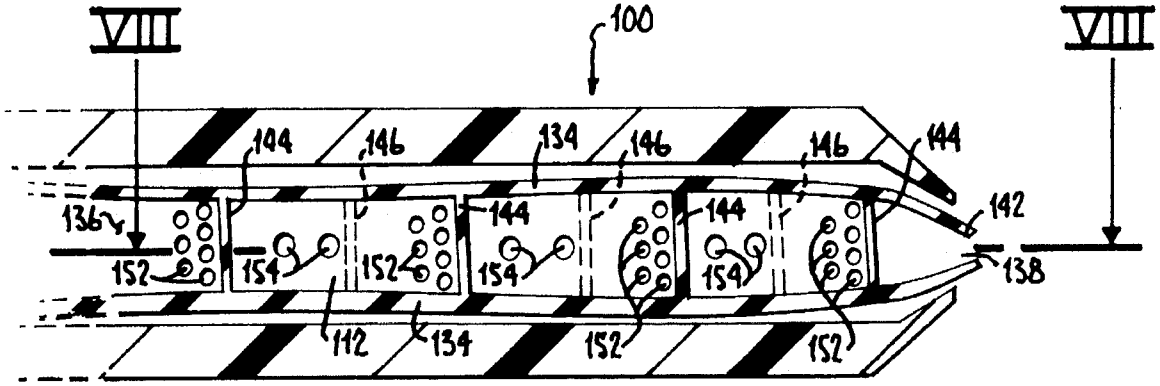
FIG. 7 is a plan section view along line VII—VII of FIG. 6.
Figure 8:
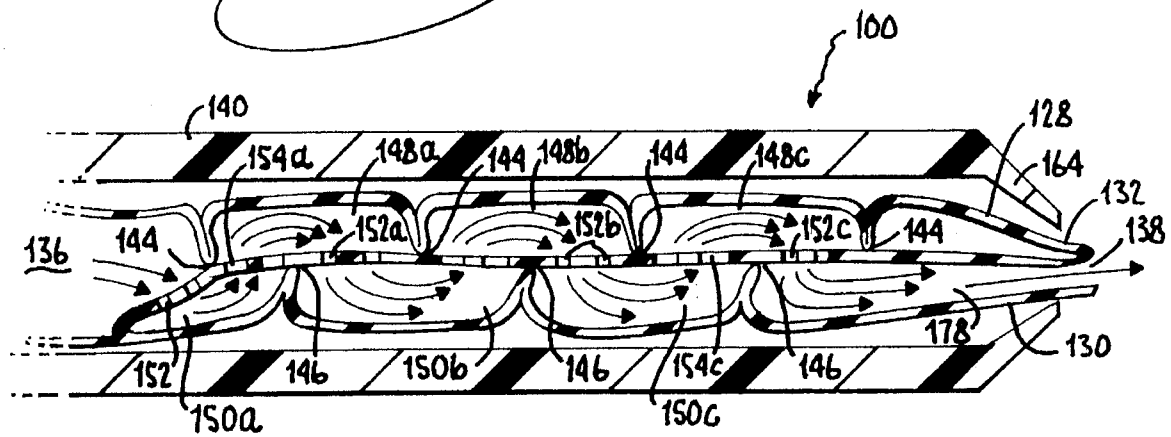
FIG. 8 is a elevation section view along line VIII—VIII of FIG. 7.

In FIGS. 1–5, the housing portion 14 is flat and spatula shaped. FIGS. 6–8 show a second embodiment of the invention. In this embodiment, static mixing device 100 contains and supports a mixing conduit 112 in a rigid tubular housing 114. A coupling member 116 can be provided separate from the housing 114, and is otherwise similar in many respects to the attachment member 48 used in association with the spatula or bayonet-shaped housing 14 of FIGS. 1–5. Attachment member 116 has screw threads 118 defined by an inner radial surface 120 for securely connecting to mating threads 52 on an outlet 54 of a container 18 on one side, and on an opposite side is structured for attachment of flexible conduit 112.

Rigid tubular housing 114 is not apt for kneading or squeezing of the flexible conduit therein. However, sufficient pressure can be applied at the source end of the conduit to move the material along the flowpath, for example by means of a source squeeze container, a piston operated mechanism such as a caulking gun, a pneumatic applicator, etc. The rigid housing also supports the flexible conduit against any tendency to balloon under pressure or to blow out along a side.

The mixing conduit 112 in this embodiment is fabricated from three facing sheets of preferably flexible material that is impermeable to the flowable components and the composition to be mixed and also non-reactive with the flowable components and the composition. A first exterior sheet 128, a second exterior sheet 130, and an intermediate sheet 132 positioned at least partly between the exterior sheets, are joined together at peripheral seams 134. A conduit inlet 136 and a conduit outlet 138 are defined by the seams 134 at an inlet end 140 and an outlet end 142 respectively.

A first set of obstructions 144 are formed by adhered portions of the intermediate sheet 132 and the first exterior sheet 128, and a second plurality of obstructions 146 are formed by adhered portions of the intermediate sheet 132 and the second exterior sheet 130. Each of the adhered portions 144, 146 extend laterally between the side seams 134 of the mixing chamber 112. Thus, the intermediate sheet 132 and the first exterior sheet 128 define a plurality of discrete first compartments 148*a*–148*c*. The intermediate sheet 132 and the second exterior sheet 130 define a plurality of discrete second compartments 150*a*–150*c*, each overlapping two adjacent first compartments 148 in a multilevel relationship.

Openings 152*a*–152*d*, 154*a*–154*c* are provided in the intermediate sheet that permit flow between each of the first compartments 148 and adjacent second compartments 150. In the embodiment illustrated, openings 152 are provided for flow from first compartments 148 into second compartments 150, and openings 154 are provided for flow from second compartments 150 into first compartments 148. Preferably, each of openings 152*a*–152*c* is smaller in size than each of openings 154*a*–154*d*, however, there are a greater number of openings 152*a*–152*d* than there are openings 154*a*–154*c* in each grouping, e.g., the sets of openings having substantially equal total cross-sectional areas such that the flow will not be excessively inhibited at any one location. In addition, each grouping of openings 152*a*–152*d* are spatially dispersed more than each grouping of openings 154*a*–154*c*, thereby forcing the flow into a circuitous mixing path.

Inlet 136 of mixing conduit 112 is secured over a peripheral radial surface 156 of the link member 116 by a collar that, in the embodiment illustrated, can be provided by a resilient band, such as a suitably sized neoprene o-ring 162. An annular groove 160 defined in the peripheral radial surface 156 can improve the seating of the o-ring 162 and thereby the security of mixing conduit 112. Alternatively, a clamping band arrangement can be employed as in the previous embodiments. The peripheral radial surface can also define wrench flats 158 or other structures to aid in screwing coupling member 116 onto the storage container outlet 54 and in disconnecting the link 116 from housing 114.

Housing 114 is tubular and preferably includes a tapered dispensing end 164 for use as an applicator tip. The other end 166 of the housing 114 is removably securable to attachment member 116. In the embodiment shown, an arrangement 168 secures the housing 114 to the link member 116. The peripheral radial surface 156, behind a shoulder against which o-ring 162 can abut, defines a male screw thread 170 mating with female threads 172 of the housing 114 so as to capture o-ring 162 between them. An end 174 of the attachment member proximate the o-ring groove 160 can be tapered at an angle complementary to an internally tapered surface 176 of the housing 114 to capture and compress inlet end 140 of mixing conduit 112 when the housing 112 is screwed onto the threads 170 of the link member 116.

Figure 6A:
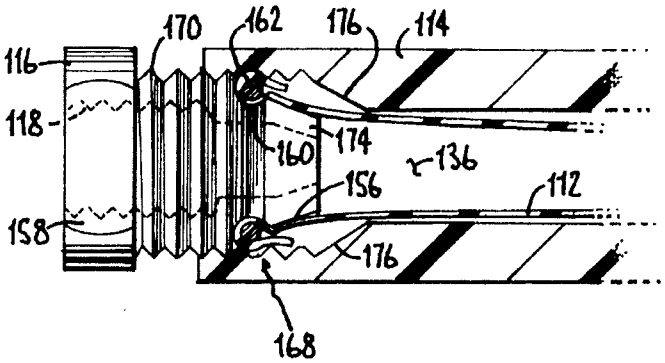
FIG. 6*a* is a partial section view through the link member shown in FIG. 6 in the area of coupling member 116.

In FIGS. 6, 6*a* and 7, attachment member 116 is male in one direction and female in the other. Insofar as the threaded neck 54 of container 18 is shaped so as to receive the inlet end of mixing conduit 112, it is also possible to omit attachment member 116 and to size the female threads of housing 112 to engage the container neck, preferably including capturing and compressively sealing with an o-ring or similar structure of inlet end 140.

It is to be understood that the mixing conduit 112 described hereinabove can be adapted for use with the coupling mechanism 16 and housing 14 hereinbefore described with reference to FIGS. 1–5 by the addition of another sheet of material adjacent to sheet 130 to form a sheath to fit over bayonet-shaped housing 14.

The mixing conduit 12 can be also used in conjunction with link 116 and housing 114. Since the sheath 44 is unnecessary in that case, the mixing conduit 12 does not need to include sheet 24 when used with attachment member 116 and housing 114.

When the mixing device 100 is assembled and connected to a container 18 of flowable components to be mixed, the flowable components can flow as indicated by arrows in FIG. 8, into the opening 136, typically by injection. The components will then flow through the set of holes 152*a* into compartment 150*a*. The components flow through holes 154*a* into compartment 148*a*, and continue downstream through holes 152*b* into compartment 150*b*, through holes 148*b* into compartment 148*b*, through holes 154*b* into compartment 150*c*, through holes 152*c* into compartment 148*c*, through holes 152*d* into end chamber 178, being mixed by the successive obstructions provided. The mixed material finally is dispensed through outlet 138. Forcing the flow through the tortuous path hereinabove described will thoroughly mix low viscosity components by turbulent mixing. The flow can be driven in any convenient manner, such as by compressing the supply container manually, by a piston driven or pneumatic applicator arrangement, and/or by compression of the flexible conduit, manually or with a pinch roller means (not shown).

Figures 9A, 9B, 9C, 9D, 9E, 9F, 9G, 9H:
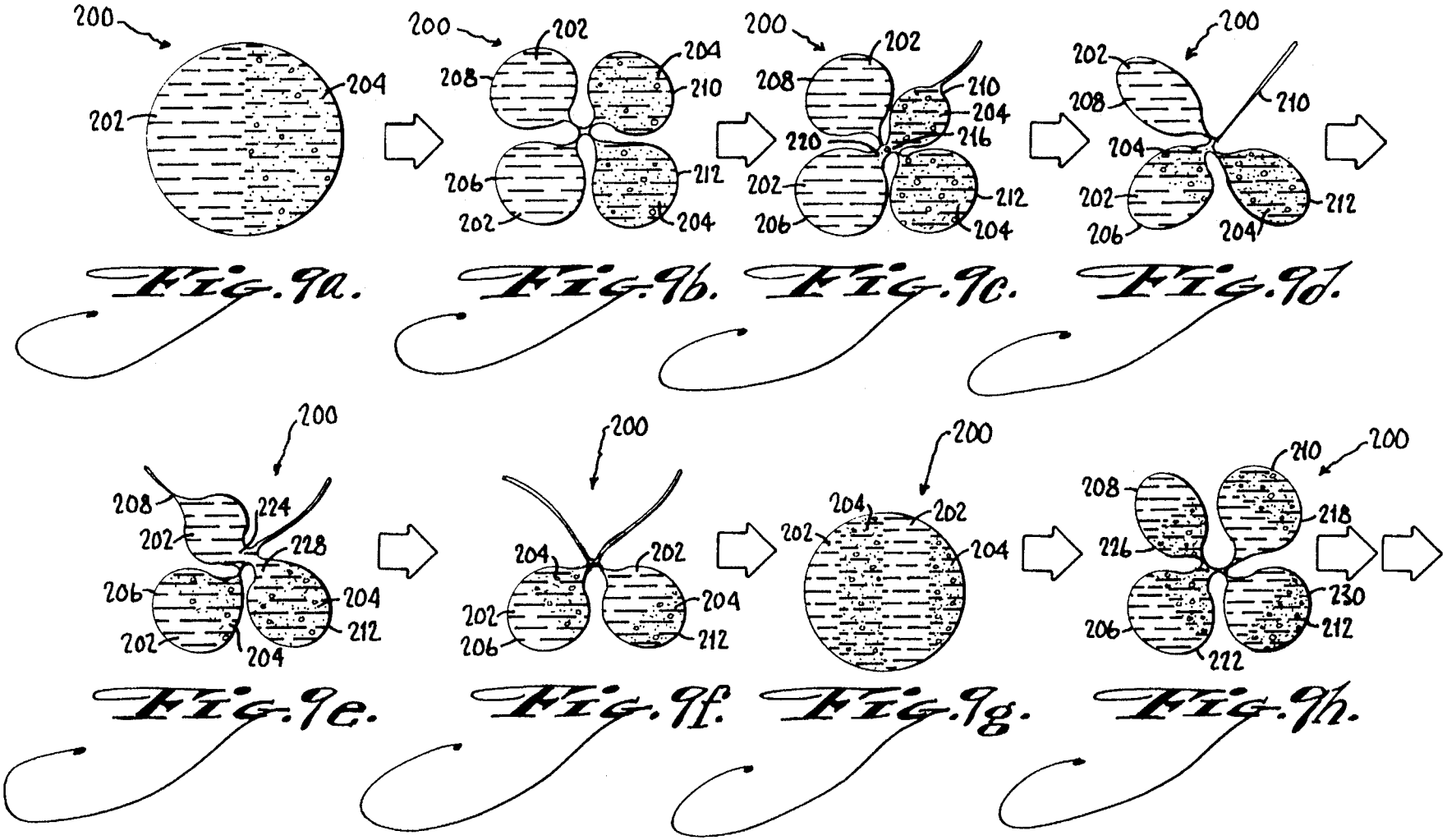
FIGS. 9*a*–9*h* are a sequence of radial sectional schematic views at succeeding longitudinal positions of a baffled conduit according to the invention, illustrating geometric mixing of two flowable components.
Figure 10:
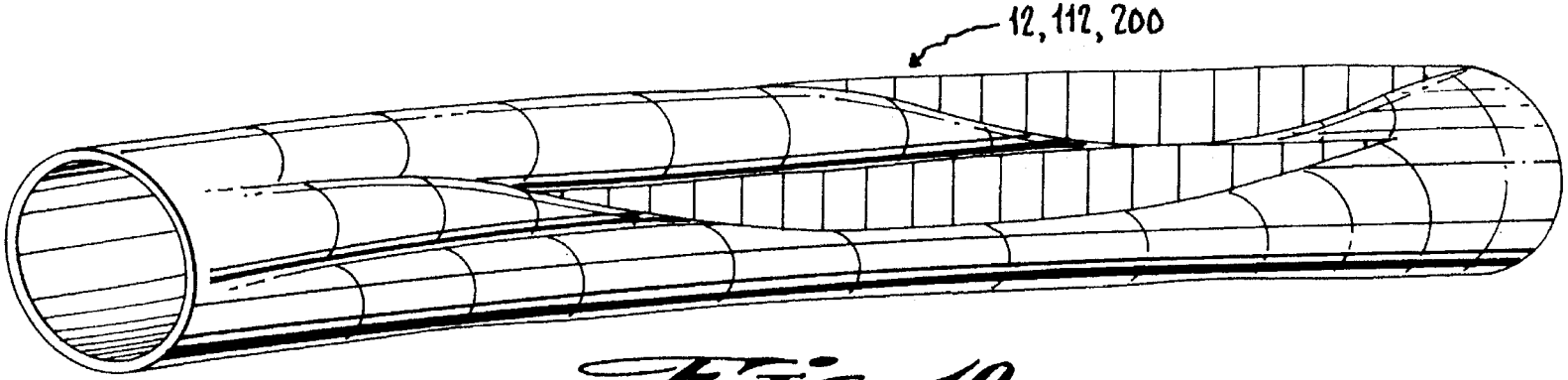
FIG. 10 is a perspective view showing the external shape of a conduit having the mixing progression shown in FIGS. 9*a*–9*h*.
Figure 11:
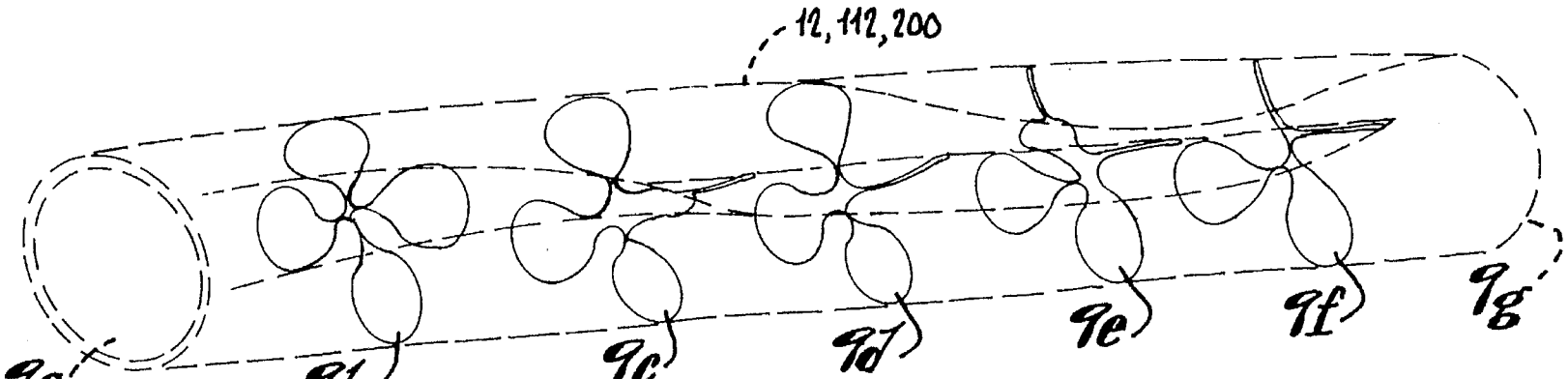
FIG. 11 is a diagrammatic illustration showing the internal lobes at spaced points along the length of conduit of FIG. 10, and corresponding to FIGS. 9*a*–9*h*.

A third embodiment of a mixing conduit 200 adapted primarily, but not exclusively, for geometric mixing of relatively more viscous flowable components of a composition is schematically illustrated in FIGS. 9*a*–9*h* and structurally in FIGS. 10 and 11. In this regard, geometric mixing can be considered subdividing and recombining streams in successive mixing stages. FIGS. 9*a*–9*h* are cross sectional views at sequential longitudinal positions of the mixing conduit 200 schematically demonstrating the mixing effect of the device as described above, FIG. 9*a* being the furthest upstream in the flow and FIG. 9*h* being the furthest downstream, as also shown in FIG. 11.

In this case, the mixing means defines a plurality of channels extending longitudinally along the flowpath, into which the components are separated while moving along the flowpath. The channels are laterally coextensive and seams are arranged longitudinally along the flowpath to open and close lateral passages between the channels as the components move along the flowpath. This directs material flowing in respective ones of the channels to combine with material flowing in others of the channels.

FIG. 9*a* depicts component 202 and component 204 in two adjacent layers as they move in an initially laminar flow in a direction normal to the plane of the drawing, through an initial open area of mixing conduit 200. Conduit 200 is substantially tubular, but along the flowpath the conduit is formed into respective lobes by seams. The seams successively separate the flow of material into channels defined by the lobes and then narrow the lobes to force material in one channel or lobe to combine with the material in another. This can be accomplished in a sequence as shown, using any number of channels, four being illustrated in this embodiment.

In FIG. 9*b*, four seams extend inwardly from the outside of the conduit and meet at the center, thereby forming four separate channels or lobes. Assuming that the two component materials are flowing in a substantially laminar flow (FIG. 9*a*) and are to be mixed in equal volumes, the components 202, 204 are subdivided by four angularly spaced seams into two channels by partitions along the flowpath, forming four lobes. Lobes 206, 208 carry one component and lobes 210, 212 carry the other component. Proceeding along the flowpath from FIG. 9*b* through FIG. 9*c* to FIG. 9*d*, the seam is opened centrally between two opposite lobes 210, 206, which contain different component materials, causing the materials to combine. A progressively wider or deeper seam can be formed peripherally along lobe 210, constricting the cross-sectional area of lobe 210 until in FIG. 9*d*, lobe 210 has been being closed off by the seam, forcing component 204 across a central region of the conduit to combine with the contents of opposite lobe 206. At FIG. 9*d*, the seams are again joined, now forming three open lobes and one closed off lobe.

The process is repeated proceeding along the flowpath from FIG. 9*d* through 9*e* to 9*f*, with lobe 208 being pinched off and its contents combined across the center with the contents of lobe 212. Downstream of FIG. 9*f*, the contents of lobes 206, 212 are recombined (FIG. 9*g*), and due to the successive combination of component materials 202, 204, the cross-section of the flow as recombined at FIG. 9*g* now has interleaved areas of concentration of the components. This process can be repeated as suggested by FIG. 9*h*. Each division and recombination mixes the materials more completely.

In FIGS. 9*a*–9*g*, combination of the materials along the flowpath is achieved by reducing the cross sectional area of a lobe to combine the materials across the centerline of the conduit. It will be appreciated that it is also possible to effect mixing across the centerline or mixing between adjacent lobes simply by opening the seam between the lobes to be mixed, and guiding the material into a downstream lobe (e.g., having twice the cross-sectional area of either of the upstream lobes) without reducing the total cross sectional area along the flowpath. The seams first isolate the lobes to be mixed, combine their contents, and recombine the contents as thereby combined, proceeding in successive steps.

Assuming that the materials are viscous enough that eddy currents are minimal, mixing in this manner causes the lobes or subdivisions to contain a portion of component 202 and a portion of component 204, which flow adjacent to one another as seen in FIGS. 9*d*–9*f*. However, recombination of the subdivided and partly mixed lobes causes the components 202 and 204 to become alternately layered, and when repeated over a number of cycles of subdivision and recombination, the mixing is complete. If the materials are less viscous, the process achieves mixing even more easily because the materials additionally diffuse into one another due to turbulence.

The mixing conduit 200 can be fabricated from four facing sheets of flexible material joined at their common edges in a manner similar to that described for the mixing chambers 12 and 112, and having obstructions that vary along the flowpath as described, to effect subdivision and recombination steps. The mixing conduit 200 also can be fabricated from a tube of material whose opposite walls are selectively heat sealed together to form the sequence of opening and closing lobes. Thus the lobes 206, 208, 210, 212, the openings 216, 220, 224, 228 between them and the outer walls 218, 222, 226, 230 can be formed by making adhesions between appropriate sheets having correspondingly placed flow openings.

It should be understood that each of the mixing conduits 12, 112, and 200 can be used with the tubular housing 114 and link 116, or if a sheath as described hereinabove with reference to device 10 is used, with housing 14 or a housing equivalently structured.

Whereas particular embodiments of the invention have been described herein as examples, it will be appreciated that variations of the details may be made without departing from the invention. Therefore, reference should be made to the appended claims rather than to the foregoing discussion of preferred examples, in order to assess the scope of the invention in which exclusive rights are claimed.

We claim:

1. A static mixing device for mixing at least two flowable components of a composition from a separate storage container, comprising:

a disposable mixing conduit having at least two facing sheets of material, at least one of the facing sheets being flexible, the sheets being sealed together at seams such that the conduit defines a peripheral edge, a conduit inlet at an inlet end of the conduit, a conduit outlet at an outlet end of the conduit, and an internal mixing portion communicating with the conduit inlet and the conduit outlet, the mixing portion forming a mixing means operable to mix the flowable components when said components are moved along a flowpath from the conduit inlet to the conduit outlet due to at least one obstruction formed by the sheets and seams, along the flowpath between opposing portions of two of the facing sheets;

a rigid, reusable housing for supporting the mixing conduit; and, reusable coupling means supported by the housing, the coupling means being structured to provide a sealed connection between the storage container and the conduit inlet, whereby a flow of the at least two components entering the conduit inlet from the container is combined upstream of the at least one obstruction along the flowpath, divides at the at least one obstruction and recombines downstream of the at least one obstruction, said at least two components becoming mixed along the flowpath;

wherein the storage container has a storage container outlet and the coupling means includes a substantially annular attachment member comprising an inner radial surface defining structure for connecting to the storage container outlet, a peripheral radial surface and a collar positioned circumferentially around the peripheral radial surface, the inlet end of the mixing conduit being captured between the peripheral radial surface and an interior surface of the collar.

2. The static mixing device of claim 1, wherein the storage container outlet has a threaded peripheral radial surface and the static mixing device is coupleable to a threaded peripheral radial surface of the storage container, the inner radial surface of the annular attachment member having female threads coupleable to male threads on the storage container outlet.

3. The static mixing device of claim 1, wherein the housing comprises an elongated member having one end attached to the coupling means, and wherein the mixing conduit forms a sleeve for sliding over another end of the elongated member.

4. The static mixing device of claim 3, wherein the elongated member is substantially bayonet-shaped.

5. The static mixing device of claim 1, wherein the housing comprises a tube connecting at one end to an adjustable collar, the mixing conduit being supported in the tube.

6. The static mixing device of claim 1, wherein the mixing means defines a circuitous flowpath for providing turbulent mixing of the at least two flowable components.

7. The static mixing device of claim 6, wherein the mixing means is delimited by the seams at opposing sides of the mixing conduit defining alternating narrow portions and wide portions of the circuitous flowpath.

8. The static mixing device of claim 7, comprising a plurality of obstructions located at the wide portions, whereby the at least two flowable components are combined upstream of the obstructions at the wide portions, subdivided by the obstructions and recombined downstream of the obstructions.

9. The static mixing device of claim 7, wherein the facing sheets comprise first and second exterior sheets, and an intermediate sheet positioned at least partly between the exterior sheets, a plurality of obstructions being formed by adhered portions of the intermediate sheet and one of the first and second exterior sheets, each of the adhered portions extending laterally between side seams of the mixing means, whereby the intermediate sheet and the first exterior sheet define a plurality of discrete first compartments and the intermediate sheet and the second exterior sheet define a plurality of discrete second compartments, openings being provided in the intermediate sheet permitting flow between adjacent ones of the first compartments and second compartments, whereby the components travel through the openings alternately along the flowpath.

10. The static mixing device of claim 1, wherein the mixing means is structured to successively subdivide and recombine the at least two flowable components while said components move along the flowpath, whereby the components are geometrically mixed.

11. The static mixing device of claim 10, wherein the mixing means has a plurality of obstructions which define a plurality of channels extending longitudinally along the flowpath, into which the components are separated while moving along the flowpath, the channels being laterally coextensive and the obstructions being arranged longitudinally along the flowpath to open and close lateral passages between the channels as the components move along the flowpath, for directing material flowing in respective ones of the channels to combine with material flowing in others of the channels and to recombine the channels downstream along the flowpath.

12. The static mixing device of claim 11, wherein the wherein the mixing means is delimited by the side seams at opposing sides, and the obstructions are arranged in at least two groups defining at least two groups of channels, the side seams including at least two progressive restrictions arranged successively defining narrow passages between said at least two groups of channels.

13. The static mixing device of claim 12, wherein at least two groups of three obstructions are provided defining at least two groups of four coextensive channels, a first group of channels having a first, second, third and fourth channel and a second group of channels and wherein the mixing means successively combines a first and third channel and then a second and fourth channel, recombines and again subdivides into the second group of channels, proceeding in successive stages along the flowpath.

14. The static mixing device of claim 12, wherein the at least two progressive restrictions are provided by pinched off areas where the facing sheets are attached by progressively wider seams proceeding along the flowpath.

* * * * *